US006364701B1

(12) United States Patent
O'Sullivan et al.

(10) Patent No.: US 6,364,701 B1
(45) Date of Patent: Apr. 2, 2002

(54) SYSTEM FOR TERMINATING THE SHIELD OF A HIGH SPEED CABLE

(75) Inventors: Michael O'Sullivan, Willowbrook; Paul Murphy, Naperville, both of IL (US)

(73) Assignee: Molex Incorporated, Lisle, IL (US)

( * ) Notice: Subject to any disclaimer, the term of this patent is extended or adjusted under 35 U.S.C. 154(b) by 899 days.

(21) Appl. No.: 08/834,080

(22) Filed: Apr. 14, 1997

Related U.S. Application Data

(63) Continuation of application No. 08/609,302, filed on Mar. 1, 1996, now abandoned.

(51) Int. Cl.[7] ..... H01R 9/05
(52) U.S. Cl. ..... 439/579; 439/497; 439/874
(58) Field of Search ..... 439/579, 874, 439/578, 608, 497, 398, 395, 101, 400

(56) References Cited

U.S. PATENT DOCUMENTS

| | | | | |
|---|---|---|---|---|
| 3,916,139 A | | 10/1975 | Schantz | 219/85 |
| 4,491,381 A | | 1/1985 | Hamsher, Jr. et al. | 339/107 |
| 4,813,388 A | | 3/1989 | Tokizane et al. | 429/583 |
| 4,978,314 A | * | 12/1990 | Maejma | 439/398 |
| 5,184,965 A | | 2/1993 | Myschik et al. | 439/578 |
| 5,190,473 A | | 3/1993 | Mroczkowski et al. | 439/580 |
| 5,197,893 A | | 3/1993 | Morlion et al. | 439/101 |
| 5,241,135 A | | 8/1993 | Fetzer | 174/88 R |
| 5,281,762 A | * | 1/1994 | Long et al. | 439/579 |
| 5,304,069 A | * | 4/1994 | Brunker et al. | 439/608 |
| 5,385,490 A | * | 1/1995 | Demeter et al. | 439/579 |

FOREIGN PATENT DOCUMENTS

| | | |
|---|---|---|
| EP | 0654847 A1 | 5/1995 |
| WO | WO9426004 | 11/1994 |

* cited by examiner

*Primary Examiner*—Tho D. Ta
(74) *Attorney, Agent, or Firm*—Charles S. Cohen

(57) ABSTRACT

A terminal system having a terminal ground plate portion with a hump projecting therefrom is adapted to terminate an inner metallic shield of a high speed cable, the cable having an outer jacket and the inner metallic shield with a portion of the outer jacket removed to expose a portion of the metallic shield. The hump has a slot for receiving the cable at a location along the cable in registry with the exposed metallic shield thereof. With the metallic shield maintained in the slot, a solder connection is established between the metallic shield and the ground plate portion at the hump.

26 Claims, 4 Drawing Sheets

SYSTEM FOR TERMINATING THE SHIELD OF A HIGH SPEED CABLE

CROSS REFERENCE TO RELATED APPLICATION

This application is a continuation application of U.S. patent application Ser. No. 08/609,302, filed Mar. 1, 1996, now abandoned, entitled "SYSTEM FOR TERMINATING THE SHIELD OF A HIGH SPEED CABLE", which prior application is assigned to the same assignee as the assignee of the present application.

FIELD OF THE INVENTION

This invention generally relates to the art of electrical connectors and, particularly, to a system for terminating the metallic shield of a high speed cable, such as the metallic braid of the cable.

BACKGROUND OF THE INVENTION

A typical high speed cable includes a center conductor or core surrounded by a tube-like inner dielectric. A shield is disposed outside the inner dielectric for shielding and/or grounding the cable. The shield typically is a tubular metallic braid. However, one or more longitudinal conductive wires have also been used and are commonly called "drain wires." An insulating jacket surrounds the composite cable outside the shield.

Various types of connectors are used to terminate high speed cables. The connectors typically have contacts which are terminated to the center conductor or core of the cable. The connectors also have one form or another of a terminating member for terminating the metallic shield of the high speed cable, usually for grounding purposes. A typical system in such connectors terminates the metallic shield to the terminating member by soldering. Other systems use crimping procedures to crimp at least a portion of the terminating member securely to the metallic braid for commoning purposes.

With the ever-increasing miniaturization of the electronics in various industries, such as in the computer and telecommunications industries, along with the accompanying miniaturization of electrical connectors, considerable problems have been encountered in terminating miniature high speed cables, particularly in terminating the metallic shield of the cable. For instance, the outside diameter of a small coaxial cable may be on the order of 0.090 inch. The outside diameter of the inner dielectric surrounding the conductor/core may be on the order of 0.051 inch, and the diameter of the center conductor/core may be on the order 0.012 inch. Coaxial cables having even smaller dimensional parameters have been used.

The problems in terminating such very small coaxial cables often revolve around terminating the metallic shield of the cable. For instance, if soldering methods are used, applying heat (necessary for soldering) in direct proximity to the metallic shield can cause heat damage to the underlying inner dielectric and, in fact, substantially disintegrate or degrade the inner dielectric. If conventional crimp-type terminations are used, typical crimping forces often will crush or deform the inner dielectric surrounding the center conductor/core of the cable.

The above problems are further complicated when the metallic shield of the high speed cable is not terminated to a cylindrical terminating member, but the shield is terminated to a flat terminating member or contact. For instance, it is known to terminate the tubular metallic shield or braid of a coaxial cable to a flat ground circuit pad on a printed circuit board. This is accomplished most often by simply gathering the tubular metallic braid of the coaxial cable into a twisted strand or "pigtail" which, in turn, is soldered to the flat ground pad on the circuit board.

Another example of terminating the metallic shield or braid of a coaxial cable to a flat ground member is shown in U.S. Pat. No. 5,304,069, dated Apr. 19, 1994 and assigned to the assignee of the present invention. In that patent, the metallic braids of a plurality of coaxial cables are terminated to a ground plate of a high speed signal transmission terminal module. The conductors/cores of the coaxial cables are terminated to signal terminals of the module.

In terminating the tubular metallic shields or braids of high speed cables to flat ground contact pads as in a printed circuit board, or to a planar ground plate as in the above-referenced U.S. patent, or to any other flat or non-tubular terminating member, various design considerations should be considered as has been found with the present invention. It should be understood that there is a transition zone created where the center conductor/core of the high speed cable goes from a "controlled environment" wherein the conductor/core is completely surrounded by the tubular metallic shield or braid, to an "uncontrolled environment" where the braid is spread away from the conductor/core for termination to the non-tubular terminating member. It is desirable that this transition zone be held to as small an area as possible and as short a length (i.e., longitudinally of the cable) as possible. Preferably, the metallic shield or braid should be terminated over an area (or at least at two points) approximately 180° apart in relation to the center conductor/core of the cable. Preferably, the flat terminating member should overlap or at least extend to the point where the metallic shield or braid is separated from its tubular configuration surrounding the conductor/core of the cable. Still further, it is desirable that the metallic shield or braid of any given high speed cable be terminated on the same side of the flat terminating member as the center conductor/core of the cable.

The present invention is directed to solving the above-identified problems and satisfying as many of the above-identified design parameters as possible in an improved system for terminating the metallic shield of a high speed cable to a terminating member, such as a ground plate.

SUMMARY OF THE INVENTION

An object, therefore, of the invention is to provide a new and improved system or terminal for terminating the metallic shield of a high speed cable.

In the exemplary embodiment of the invention, at least one high speed cable is prepared by removing a portion of the outer jacket of the cable to expose a portion of the metallic shield of the cable. The terminal includes a conductive ground plate portion. A hump projects from one side of the ground plate portion, and the hump has a slot for receiving the cable at a location along the cable in registry with the exposed metallic shield thereof. A solder connection is provided between the metallic shield and the ground plate portion at the hump.

As disclosed herein, the terminal is stamped and formed of conductive sheet metal material, with the ground plate portion being generally planar, and with the hump being formed out of the ground plate portion. The solder connection is located substantially within the slot. Preferably, the slot has a width that is dimensioned to receive the high speed cable with a press-fit at the exposed metallic shield thereof.

The preferred embodiment of the invention includes one of the humps on each opposite side of the ground plate portion. Each of the humps includes a pair of the slots for receiving a pair of cables in a generally parallel side-by-side relationship on each opposite side of the ground plate portion. Therefore, the terminal can terminate the metallic shields of four generally parallel cables.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
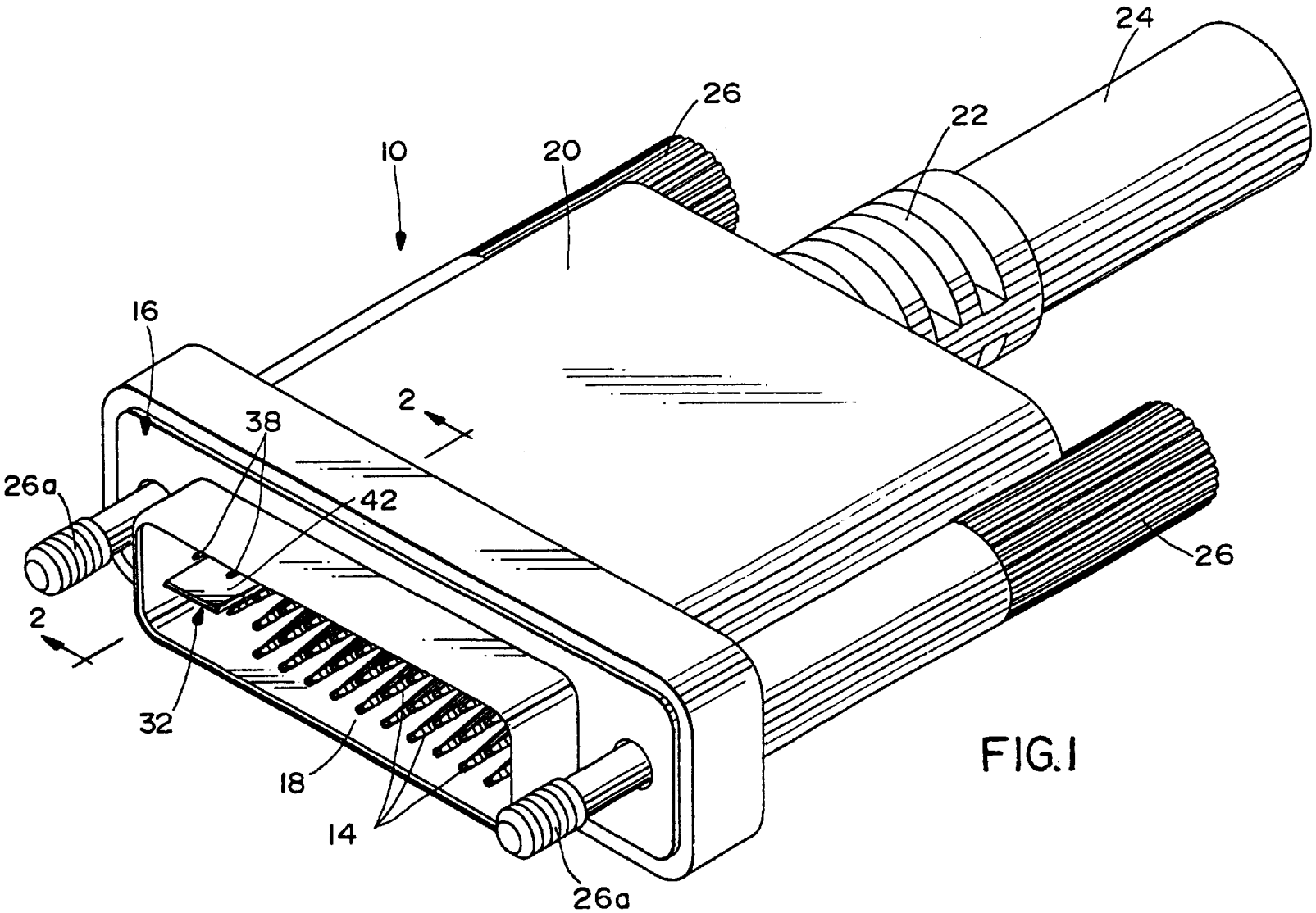
FIG. 1 is a perspective view of an electrical connector of a type in which the invention is applicable.
Figure 2:
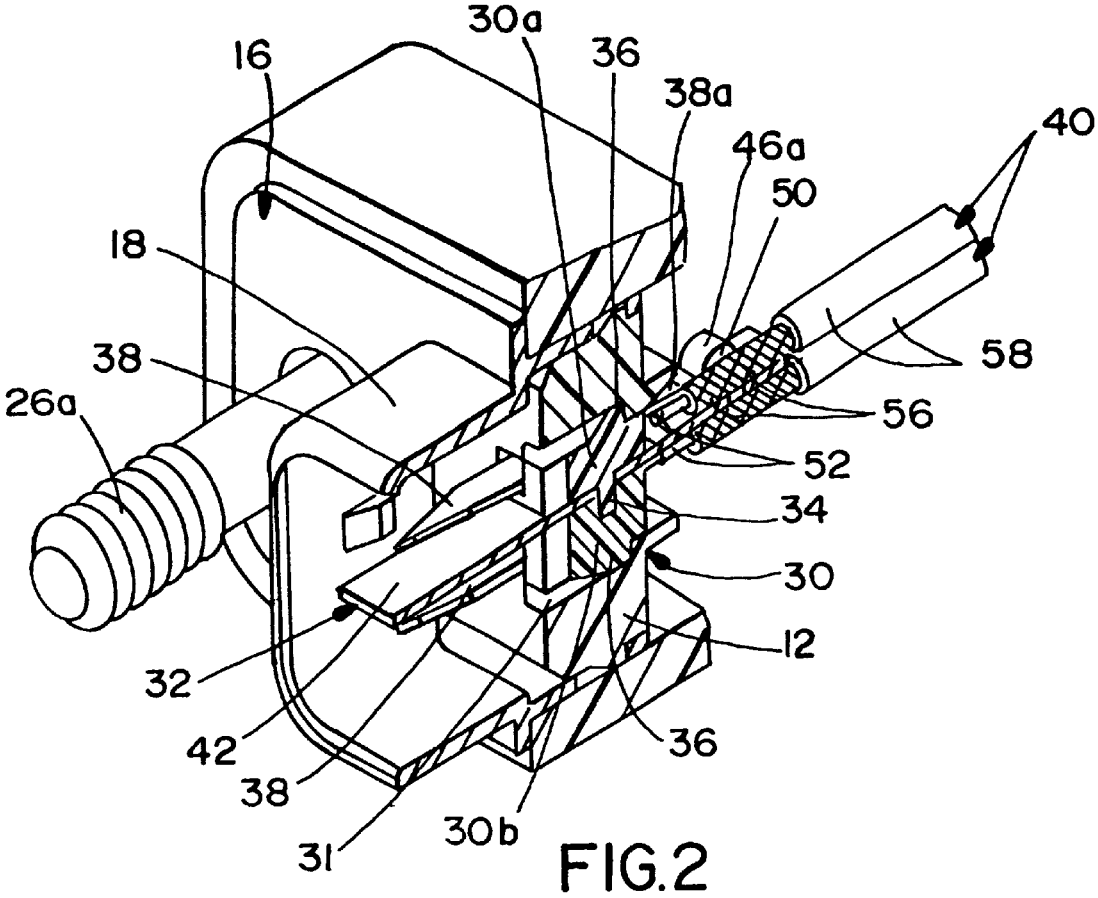
FIG. 2 is a fragmented vertical section taken generally along line 2—2 of FIG. 1.

Referring to the drawings in greater detail, and first to FIGS. 1 and 2, the invention is embodied in a shielded electrical connector, generally designated 10, which is a hybrid electrical connector for terminating both the conductors of slower data transmission lines and the conductors of high speed or high frequency transmission lines. In particular, electrical connector 10 includes a dielectric housing 12 (FIG. 2) mounting a plurality of data transmission terminals 14 (FIG. 1). A conductive shield, generally designated 16, substantially surrounds dielectric housing 12 and has a shroud portion 18 projecting forwardly about the mating ends of data transmission terminals 14. A two-piece backshell (not shown) substantially in conformance with that shown in U.S. Pat. No. 5,358,428, dated Oct. 25, 1994, projects rearwardly of housing 12 and shield 16. An overmolded boot 20 includes an integral cable strain-relief 22 that is in engagement with a composite electrical cable 24 which includes both the data transmission lines and the high speed or high frequency transmission lines. A pair of thumb screws 26 project through the overmolded boot and include externally threaded forward distal ends 26*a* for securing the connector to a complementary mating connector, panel or other structure.

As seen best in FIG. 2, a high speed signal transmission terminal module, generally designated 30, is inserted into a passage 31 in dielectric housing 12 from the rear thereof. The terminal module includes a pair of identical terminal blocks 30*a* and 30*b* which clamp a ground plate, generally designated 32, therebetween. Each terminal block includes a post 34 and a recess. The post from each terminal block extends from each terminal block through a hole or slot 44 (FIG. 3) in the ground plate and into a recess in the other terminal block to secure terminal blocks 30*a* and 30*b* to ground plate 32 as a subassembly. Once this subassembly is inserted into passage 31 in housing 12 as shown in FIG. 2, the terminal blocks are effective to clamp the ground plate therebetween. The terminal module is held within the dielectric housing by ramped latches 36 on each terminal block.

Each terminal block 30*a* and 30*b* is overmolded about at least one high speed signal terminal 38. The contact ends of a pair of the terminals 38, along with the forward end of ground plate 32, are shown projecting forwardly of the connector in FIG. 1, within the surrounding shroud portion 18 of shield 16. The rear ends 38*a* of terminals 38 (FIG. 8) are terminated to the center conductor/cores 52 of a plurality of coaxial cables, generally designated 40 in FIG. 2. The invention is particularly directed to the manner of termination of the metallic shields of the coaxial cables to ground plate 32, as described below.

Figure 3:
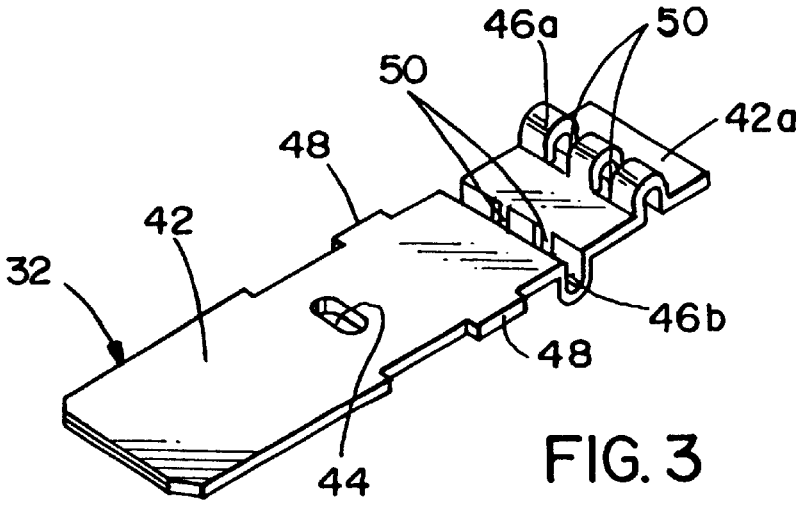
FIG. 3 is a perspective view of the stamped and formed metal terminal or ground plate.

More particularly, FIG. 3 shows ground plate 32 stamped and formed from conductive sheet metal material. The ground plate includes an elongated, generally planar leg or stem portion 42 which will form a blade portion for the ground plate. The blade portion includes an aperture or slot 44 through which posts 34 (FIG. 2) of terminal blocks 30*a* and 30*b* extend. A pair of elongated, transversely extending humps 46*a* and 46*b* are formed at a terminating end 42*a* of blade portion 42. As viewed in FIG. 3, hump 46*a* can be considered the upper hump and hump 46*b* can be considered the lower hump. Hump 46*a* is closer to terminating end 42*a* than hump 46*b*. Lastly, barbs or teeth 48 are stamped at the opposite edges of blade portion 42 to facilitate holding the subassembly of the ground plate 32 and terminal blocks 30*a* and 30*b*, within the housing.

It can be seen in FIG. 3 that each hump 46*a* and 46*b* includes a pair of transversely spaced slots 50. As will be seen hereinafter, these slots are dimensioned for receiving four coaxial cables with the metallic shields of the cables terminated to ground plate 32. In essence, the ground plate terminates a pair of coaxial cables on each opposite side of blade portion 42 within the pair of slots 50 in one of the humps 46*a* or 46*b*. With this structure, the ground plate can terminate from one to four coaxial cables depending on the specifications of the connector. In some computer applications, three cables may be used to carry the red, green and blue chroma signals for a monitor. A fourth cable might be used for flat screen monitors for carrying the pixel clock timing signals.

Figure 4:
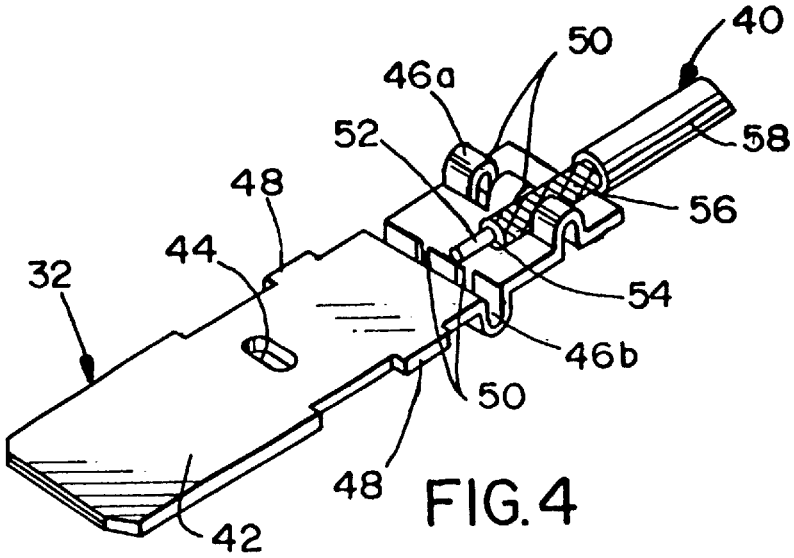
FIG. 4 is a perspective view of the ground plate receiving one coaxial cable on one side thereof.

FIG. 4 shows one coaxial cable 40 positioned on ground plate 32. At this point, it should be understood that each coaxial cable 40 is of a conventional construction in that each cable includes a center conductor or core 52 surrounded by a tube-like inner dielectric material 54. A metallic shield in the form of a tubular metallic braid 56 surrounds inner dielectric 54. An insulating jacket 58, as of plastic or the like, surrounds metallic braid 56 to form the overall composite coaxial cable 40.

Figure 8:
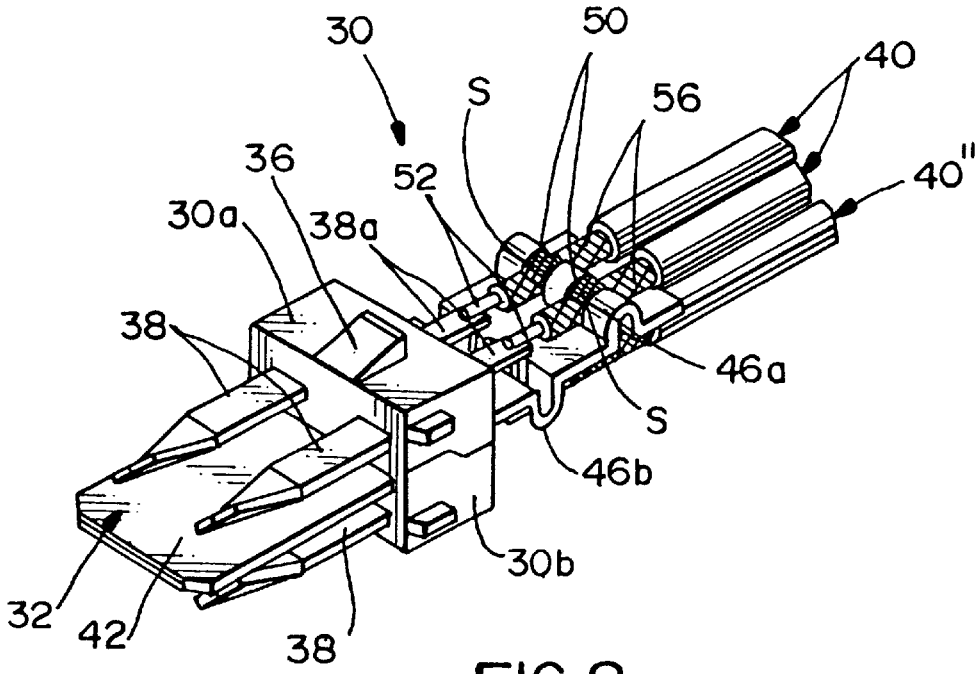
FIG. 8 is a perspective view of the terminal module mountable in the connector of FIGS. 1 and 2.

FIG. 4 also shows that center conductor/core 52 of coaxial cable 40 has been stripped to expose a given length thereof which will be soldered, welded or otherwise secured to the inner end 38*a* of one of the high speed signal transmission terminals 38 (FIGS. 2 and 8). The outer insulating jacket 58 of cable 40 also has been cut-back to expose a given length of the respective metallic shield 56. The coaxial cable is shown in FIG. 4 received in the left-hand slot 50 of upper hump 46*a* at a longitudinal location of the cable in registry with the exposed metallic shield of the cable. In other words, the exposed metallic shield is positioned within the slot. The slot has a width that is dimensioned to receive the coaxial cable with a slight press-fit at the exposed metallic shield 56 thereof.

Figure 5:
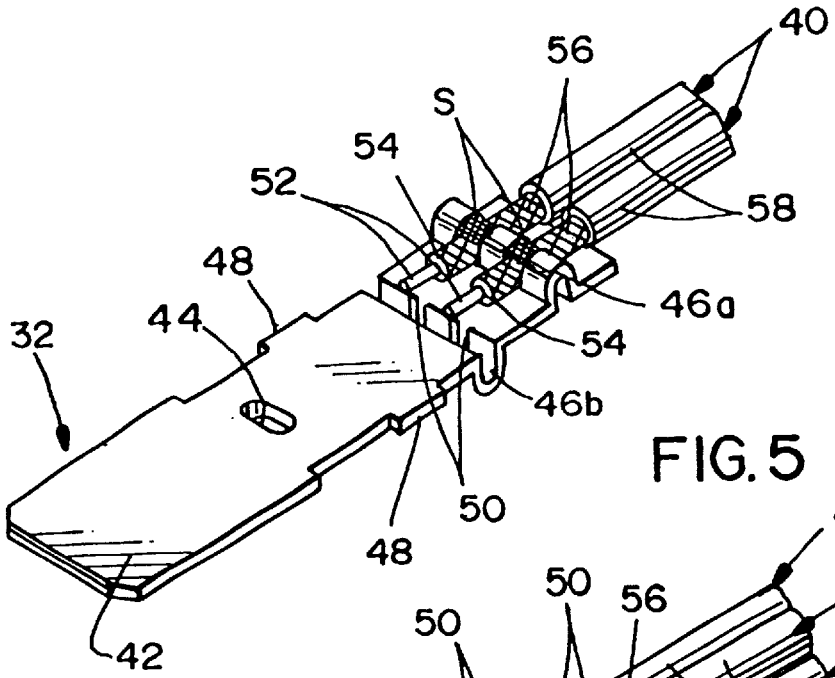
FIG. 5 is a view similar to that of FIG. 4, but showing the ground plate soldered to two coaxial cables.

Ground plate 32 then is mechanically and electrically connected to metallic shields 56 of the coaxial cables by soldering the metallic shields to humps 46*a* and 46*b* within slots 50. FIG. 4 shows one of the coaxial cables positioned with the exposed metallic shield 56 thereof positioned within one of the slots of the upper, end-most hump 46*a*. FIG. 5 shows two coaxial cables 40 positioned within both slots 50 of hump 46*a*. A solder connection "S" is formed between metallic shields 56 and hump 46*a* within slots 50 as shown in FIG. 5. In the alternative, a slug of solder material (not shown) may be press-fit within hump 46*a* at slots 50 and then reflowed during the soldering operation. In still another embodiment, a secondary metallic member (not shown) could be press fit within hump 46*a* to electrically and mechanically interconnect the cable shields and ground plate 32.

Figure 6:
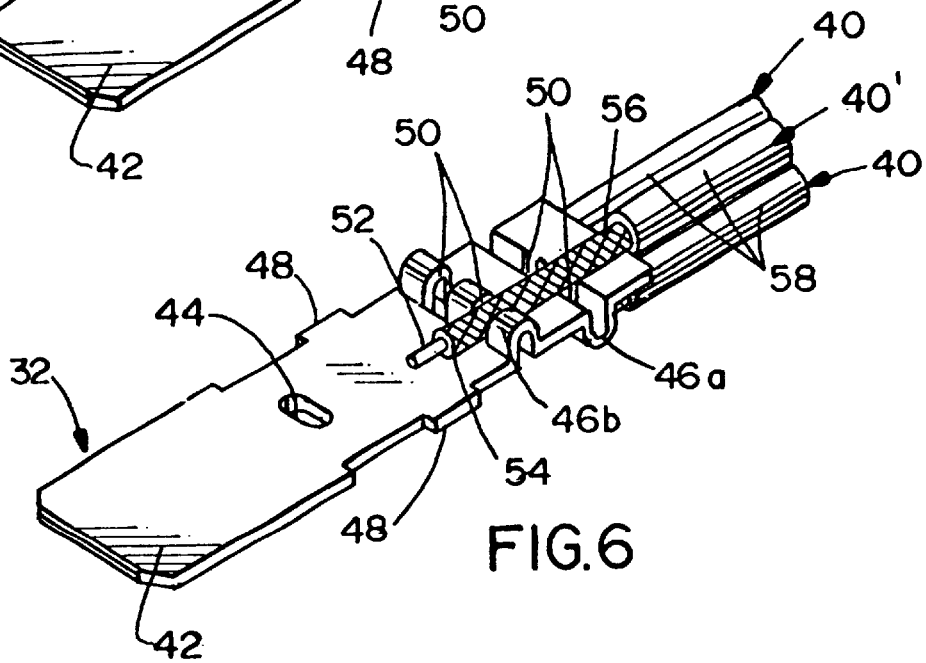
FIG. 6 is a view similar to that of FIG. 5, but showing the ground plate inverted and with a third coaxial cable received thereon.

FIG. 6 shows ground plate 32 having been inverted or flipped-over so that lower hump 46*b* now is facing upwardly, after the previous two coaxial cables 40 have been solder connected within slots 50 of the end-most hump 46*a* as described above in relation to FIG. 5. A third coaxial cable 40' is positioned with its exposed metallic shield 46 within the left-hand slot 40 of hump 46*b*.

Figure 7:
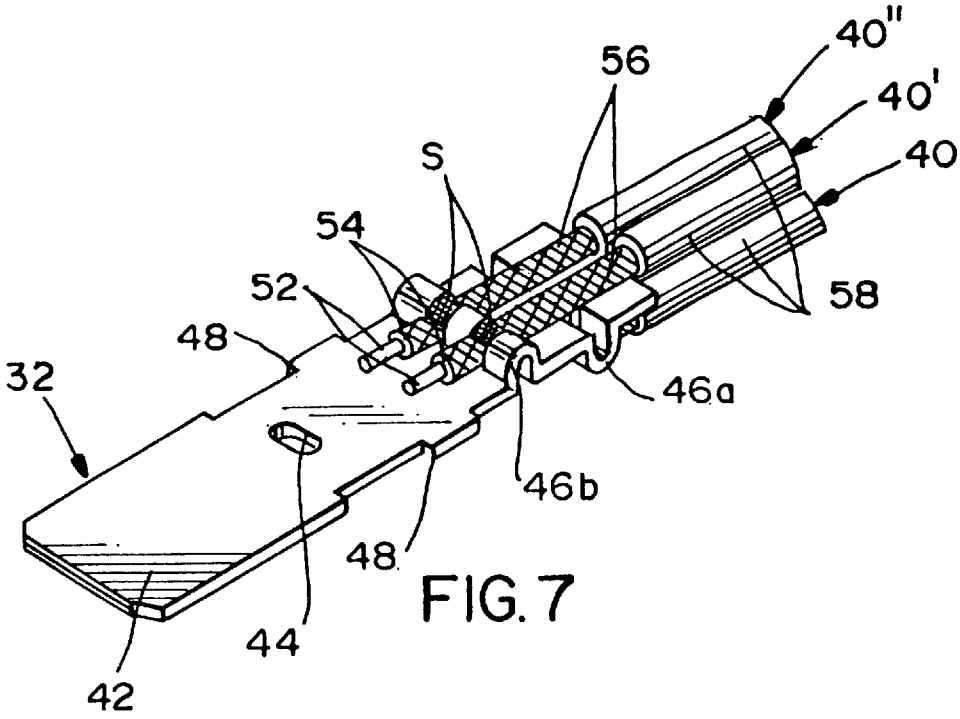
FIG. 7 is a view similar to that of FIG. 6, but showing all four coaxial cables soldered to the ground plate.

FIG. 7 shows a fourth coaxial cable 40" positioned with its metallic shield 56 within the right-hand slot of hump 46*b*. The third and fourth coaxial cables 40' and 40", respectively, then are terminated to ground plate 32 by solder connections "S" applied between the metallic shields 56 of the cables and hump 46*b* within slots 50.

It can be seen that the terminating end 42*a* of ground plate 32 overlaps the points where metallic shields 56 of the coaxial cables are exposed outside the outer jackets 58 of the cables.

Once the subassembly of FIG. 7 is fabricated, including the soldering procedures, this subassembly is assembled to terminal blocks 30*a* and 30*b* including high speed signal transmission terminals 38 to form terminal module 30 as shown in FIG. 8 and described above in relation to FIG. 2. Center conductors/cores 52 of the coaxial cables are then connected, as by soldering, welding or otherwise securing to the inner ends 38*a* of terminals 38, while terminal blocks 30*a* and 30*b* clamp blade portion 42 of ground plate 32 therebetween, as shown in FIGS. 2 and 8 and described above. The terminal module of FIG. 8 then is mounted within dielectric housing 12 as shown in FIG. 2. If desired, terminal blocks 30*a* and 30*b* could be mounted to blade portion 42 of ground plate 32 prior to inserting cables 40', 40" into the slots 50 between the humps 46*a*, 46*b*. In other words, the ground plate would have the terminal blocks mounted thereon at the beginning of the termination process.

The concepts of the invention have been shown and described herein in conjunction with terminating the metallic shield of the coaxial cable to a terminating member 32 in the form of a ground plate. However, it should be understood that the concepts of the invention are equally applicable for terminating the metallic shields 56 to other types of terminating members or terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for termination to a pair of cables each of which includes an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield, said electrical connector comprising:

a dielectric housing having a mating face, a termination face and a plurality of terminal receiving passages between said mating face and said termination face;

a plurality of terminals extending through at least some of said terminal receiving passages; and a generally planar metal ground member having a ground plate portion disposed in said housing relative to said terminals, said ground plate portion including a hump projecting from one side of said ground plate portion, said hump having a pair of slots for receiving said cables at a location along said cables in registry with said exposed metallic shields thereof to maintain said exposed metallic shields on said ground plate portion.

2. The electrical connector of claim 1 wherein each of said slots has a width that is dimensioned to receive said exposed portion of said metallic shield of said cable with a press-fit at said exposed portion thereof and a depth dimension greater than the outside diameter of said exposed portion of said metallic shield.

3. The electrical connector of claim 1 wherein said hump includes said pair of said slots such that said pair of cables are maintained in a generally parallel side-by-side relationship on said ground plate portion.

4. The electrical connector of claim 1 further including an additional hump on a side of said ground plate portion opposite to said one side.

5. The electrical connector of claim 4 including at least one additional cable to be terminated to said ground plate portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and wherein said ground plate portion includes said additional hump with a pair of slots for receiving at least said additional exposed portion of said additional metallic shield of said additional cable such that said additional cable is maintained on said opposite side of said ground plate portion.

6. The electrical connector of claim 5 wherein each of said additional slot has a width that is dimensioned to receive said additional exposed portion of said additional metallic shield of said additional cable with a press-fit at said additional exposed portion thereof and a depth dimension greater than the outside diameter of said additional exposed portion of said additional metallic shield.

7. The electrical connector of claim 5 wherein said ground plate portion is stamped and formed of conductive sheet metal material with said hump formed out of said ground plate portion.

8. The electrical connector of claim 7 wherein said ground plate portion is generally planar and said hump is spaced longitudinally along said ground plate portion with respect to said additional hump.

9. An electrical connector for termination to at least one cable that includes an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield, said electrical connector comprising:

a dielectric housing having a mating face, a termination face and a plurality of terminal receiving passages between said mating face and said termination face;

a plurality of terminals extending through at least some of said terminal receiving passages;

a conductive shield surrounding at least a portion of said mating face; and a generally planar metal ground member having a ground plate portion disposed in said housing relative to said terminals, said ground plate portion including a hump projecting from one side of said ground plate portion, said hump having a slot for receiving said cable at a location along said cable in registry with said exposed metallic shield thereof to maintain said exposed metallic shield on said ground plate portion.

10. The electrical connector of claim 9 wherein said slot has a width that is dimensioned to receive said exposed portion of said metallic shield of said cable with a press-fit at said exposed portion thereof and a depth dimension greater than the outside diameter of said exposed portion of said metallic shield.

11. The electrical connector of claim 9 including at least one additional cable to be terminated to said ground plate portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and wherein said ground plate portion includes an additional hump on a side of said ground plate portion opposite to said one side with a slot for receiving said additional exposed portion of said additional metallic shield of said additional cable such that said additional cable is maintained on said opposite side of said ground plate portion.

12. The electrical connector of claim 11 wherein each of said additional slot has a width that is dimensioned to receive said additional exposed portion of said additional metallic shield of said additional cable with a press-fit at said additional exposed portion thereof and a depth dimension greater than the outside diameter of said additional exposed portion of said additional metallic shield.

13. The electrical connector of claim 11 wherein said ground plate portion is stamped and formed of conductive sheet metal material with said hump formed out of said ground plate portion.

14. The electrical connector of claim 13 wherein said ground plate portion is generally planar and said hump is spaced longitudinally along said ground plate portion with respect to said additional hump.

15. A termination assembly comprising:

a pair of cables each having an inner conductor, an inner dielectric surrounding at least a portion of said inner conductor, a metallic shield surrounding at least a portion of said inner dielectric and an outer insulating jacket surrounding at least a portion of said metallic shield, a portion of said outer jacket being removed to expose an exposed portion of said metallic shield;

a conductive member having a termination portion, said conductive member being at least partially disposed in a dielectric housing of an electrical connector; and a hump projecting from one side of said termination portion, said hump having a pair of slots for receiving said cables at a location along said cables in registry with said exposed metallic shields thereof to maintain said exposed metallic shields on said termination portion.

16. The termination assembly of claim 15 wherein each of said slots has a width that is dimensioned to receive said exposed portion of said metallic shield of said cable with a press-fit at said exposed portion thereof and a depth dimension greater than the outside diameter of said exposed portion of said metallic shield.

17. The termination assembly of claim 15 wherein said hump includes said pair of said slots such that said pair of cables are maintained in a generally parallel side-by-side relationship on said ground plate portion.

18. The termination assembly of claim 15 further including an additional hump on a side of said termination portion opposite to said one side.

19. The termination assembly of claim 18 including at least one additional cable to be terminated to said ground plate portion, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and wherein said ground plate portion includes said additional hump with a pair of additional slots for receiving at least said additional exposed portion of said additional metallic shield of said additional cable such that said additional cable is maintained on said opposite side of said ground plate portion.

20. The termination assembly of claim 19 wherein said ground plate portion is generally planar and said hump is spaced longitudinally along said ground plate with respect to said additional hump.

21. The termination assembly of claim 19 wherein each of said additional slots has a width that is dimensioned to receive said additional exposed portion of said additional metallic shield of said additional cable with a press-fit at said additional exposed portion thereof and a depth dimension greater than the outside diameter of said additional exposed portion of said additional metallic shield.

22. A method of terminating a pair of cables each having a inner conductor, an inner dielectric surrounding at least a portion of said inner conductor, a metallic shield surrounding at least a portion of said inner dielectric and an outer insulating jacket surrounding at least a portion of said metallic shield to an electrical connector having a dielectric housing with a mating face, a termination face and a plurality of terminal receiving passages between said mating face and said termination face and having a ground member secured within said housing, said ground member including a mating portion generally adjacent said mating face and a ground termination portion generally adjacent said termination face, comprising the steps of:

providing said cables with a portion of said outer insulating jacket of each of said cables being removed from about said metallic shield so as to expose an exposed portion of said metallic shield;

positioning said exposed portion of said metallic shield of each of said cables within a slot of a hump projecting from one side of said ground termination portion whereby said exposed portions of said metallic shields are maintained on said termination portion; and bonding said exposed portion of said metallic shield of each of said cables to said ground termination portion while said exposed portion is positioned in said slot.

23. The method of claim 22 wherein each of said slots has a width that is dimensioned to receive said exposed portion of said metallic shield of said cable with a press-fit at said exposed portion thereof and a depth dimension greater than the outside diameter of said exposed portion of said metallic shield.

24. The method of claim 22 wherein at least one additional cable is to be terminated to said ground member, said additional cable including an additional inner conductor, an additional inner dielectric surrounding at least a portion of said additional inner conductor, an additional metallic shield surrounding at least a portion of said additional inner dielectric and an additional outer insulating jacket surrounding at least a portion of said additional metallic shield, a portion of said additional outer jacket being removed to expose an additional exposed portion of said additional metallic shield and wherein said method further includes positioning said additional exposed portion of said additional metallic shield of said additional cable within one of a pair of additional slots in an additional hump extending from said ground member on a side of said ground member opposite to the side from which said hump extends, said additional slot maintaining said additional cable with respect to said opposite side of said termination portion and bonding said additional exposed portion of said additional metallic shield of said additional cable to said ground member while said additional exposed portion is positioned in one of said additional slots.

25. The method of claim 24 wherein said termination portion is an elongated ground plate and said hump is spaced longitudinally along said ground plate with respect to said additional hump.

26. The method of claim 24 wherein each of said additional slots has a width that is dimensioned to receive said additional exposed portion of said additional metallic shield of said additional cable with a press-fit at said additional exposed portion thereof and a depth dimension greater than the outside diameter of said additional exposed portion of said additional metallic shield.

* * * * *